US005214853A

United States Patent [19]

Bray et al.

[11] Patent Number: 5,214,853

[45] Date of Patent: Jun. 1, 1993

[54] FLINT STRIKER KNIFE INSERT

[76] Inventors: Robert W. Bray, Sean P. Bray, both of 232 Wilbur Blvd., Pough, N.Y. 12603

[21] Appl. No.: 846,854

[22] Filed: Mar. 6, 1992

[51] Int. Cl.[5] ..... B26B 1/00; F23Q 1/02

[52] U.S. Cl. ..... 30/123; 431/273

[58] Field of Search ..... 30/123, 13 C; 7/118, 7/119; 431/273; 206/528

[56] References Cited

U.S. PATENT DOCUMENTS 2,496,840 2/1950 Alexander ..... 431/273
2,605,944 8/1952 Maurice ..... 431/273
4,698,068 10/1987 Jensen ..... 431/273
4,783,867 11/1988 Tsao ..... 30/123
5,084,943 2/1992 DeCanio ..... 431/273

*Primary Examiner*—Douglas D. Watts
*Assistant Examiner*—Paul M. Heyrana, Sr.

[57] ABSTRACT

A fire igniting device which includes a flint adhered to a brass strip and has been fitted into the body of a bladed scout knife. The fire igniting device locks into the knife when not in use and is easily available for use when the blade is opened, the invention allows full function of the blade attached within the body of the knife.

2 Claims, 1 Drawing Sheet

FLINT STRIKER KNIFE INSERT

BACKGROUND OF INVENTION

1. Field of Invention

This invention relates generally to a folding knife with a blade and a fire igniting device inserted into the body of the knife which can be readily removed by releasing the blade for removal from the knife, and a metal stud affixed to the fire igniting device so it can be easily returned when finished.

This invention relates generally to a fire igniting device and a locking device for a folding knife to enable it to be secured when not in use.

2. Description of the Background Art

At this time there exists many types of fire igniting devices capable of igniting tinder or kindling or the like. There is a patent that bears similarity. That of Mr. P. Alexander, U.S. Pat. No. 2,496,840 Sportsman'Knife, Feb. 7, 1950. His discloses a pair of pivotal removable fire igniting devices attached to the rivets of the knife.

E. Jensen U.S. Pat. No. 4,698,068 FIRE STARTER has a fire starting device of a magnesium rod inside of the handle of a straight handled knife. Although this device is again similar it is not designed for a folding knife or has locking device of the same type.

G. Maurice U.S. Pat. No. 2,605,944 FLINT HOLDER is a fire igniting device designed to be carried on a belt with a similar intent but different approach. While it is another fire igniting device it is different.

Mr. DeCaino U.S. Pat. No. 5,084,943 FLAT FILE HOODED GAS LIGHTER FASTENING DEVICE is another fire igniting device used for gas lighters. And Mr. Tsao U.S. Pat. No. 4,783,867 by MULTI_FUNCTIONAL STATIONARY TOOL COMBINATION is an office tool lacking the fire igniting device and locking device embodied in the applied for patent.

SUMMARY OF INVENTION

It is therefore the primary object of this invention to provide a flint device that can be installed into a folding scout knife that is full function and supplies a flint for the purpose of starting a fire.

It is another object of this invention to provide a fast effortless means of removing the flint device by a young scout and to replace it when finished.

A further object is to find a low cost design to allow the production cost to be kept to a minimal and assure availability to scouts world wide.

DETAILED DESCRIPTION OF THE PREFERRED EMBODIMENT

Figure 1:
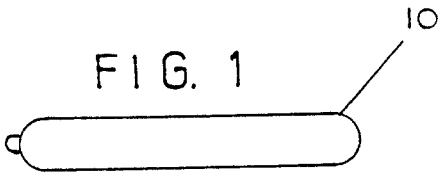
FIG. 1 is a plane view of the fire igniting device which is mounted in the body of the knife.
Figure 2:
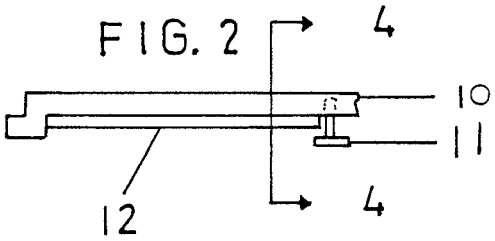
FIG. 2 is a side view of the same.
Figure 4:
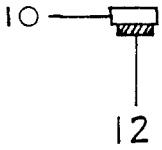
FIG. 4 is a sectional view from line 4—4 of FIG. 2.
Figure 3:
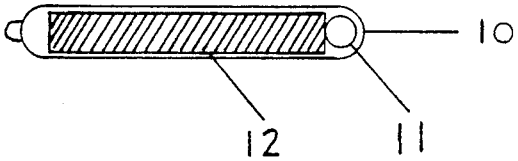
FIG. 3 is a view of the underside of the fire igniting device.

Referring to the drawings, more specifically FIGS. 1, 2, 3, and 4, an embodiment of the invention is shown in which the fire igniting device is made of a brass body 10, a flint stick 11, and a brass rivet 12, the brass body 10 has been made to accept the brass rivet or stud 12 and to receive a flint stick or other pyrophoric material 11 on the underside of the brass body 10.

Figure 5:
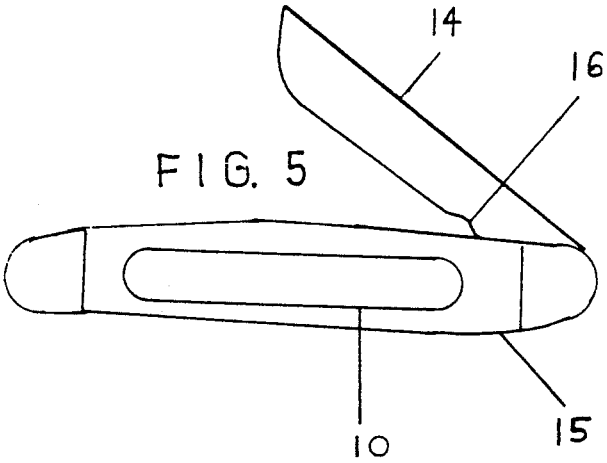
FIG. 5 is a plane view of the scout knife with the fire igniting device shown in its mounted position and locking blade extended.

As shown in FIG. 5 the fire igniting device 10 is set into the body of the scout knife 15, and depicts the short blade 14 of the knife 15 and the notch 16 in its profile to allow it to engage the shaft behind the headed stud 12 of the fire igniting device 10 that has been set into the body of the knife 15.

Figure 6:
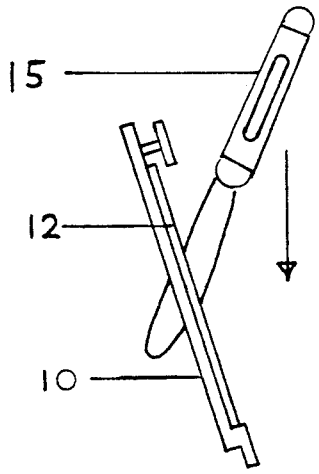
FIG. 6 is an elevational view of the fire igniting device and the scout knife with open blade in its working position.

FIG. 6 shows the removed fire igniting device 10 in an elevational view that reveals the flint stick 11, and the brass rivet 12, the brass body 10 being in an upright position and the scout knife 15 with its short blade 14 extended in the approximate angle needed to strike the flint stick 11 with the blade 14 to create the desired sparks.

I claim:

1. In a bladed scout knife having a body, a pivotally mounted blade, moveable between open and closed positions, a support strip, a fire igniting device of a pyrophoric material secured to said support strip, an opening for mounting the strip for carrying with the knife in the side of said knife a deeper opening on said opening, a stud projecting laterally from said support strip, said stud projecting into said deeper opening when the strip is mounted in said body opening, said pivotally mounted blade engaging said stud in its closed position, and leaning on the stud for precluding withdrawal of the fire igniting device in the closed position of the blade.

2. A bladed knife according to claim 1, wherein the support strip is made of brass and the pyrophoric material is flint.

* * * * *